US005653069A

United States Patent [19]

Dziedzic

[11] Patent Number: 5,653,069

[45] Date of Patent: Aug. 5, 1997

[54] TUBULAR SOCKET DRIVE EARTH ANCHOR

[75] Inventor: Edward Dziedzic, Shelby, Tenn.

[73] Assignee: Dixie Electrical Manufacturing Company, Memphis, Tenn.

[21] Appl. No.: 493,274

[22] Filed: Jun. 21, 1995

[51] Int. Cl.[6] ..... E02D 5/74

[52] U.S. Cl. ..... 52/157; 405/244; 405/259.1; 52/165

[58] Field of Search ..... 52/157, 165; 405/244, 405/259.1

[56] References Cited

U.S. PATENT DOCUMENTS

| | | | |
|---|---|---|---|
| Re. 32,076 | 2/1986 | Dziedzic . | |
| 816,857 | 4/1906 | George et al. | 52/157 |
| 1,193,725 | 8/1916 | Smith | 52/165 X |
| 1,940,938 | 12/1933 | Chance | 52/165 X |
| 4,290,245 | 9/1981 | Pardue, Jr. et al. | 52/157 |
| 4,316,350 | 2/1982 | Watson | 52/157 |
| 4,334,392 | 6/1982 | Dziedzic . | |
| 4,467,575 | 8/1984 | Dziedzic . | |
| 4,688,969 | 8/1987 | Bruser et al. | 52/157 X |
| 4,742,656 | 5/1988 | Farmer . | |
| 4,756,129 | 7/1988 | Webb | 405/244 X |
| 4,862,823 | 9/1989 | Hughes | 52/165 X |
| 4,979,341 | 12/1990 | Norman et al. . | |
| 4,981,000 | 1/1991 | Hamilton et al. . | |
| 5,358,209 | 10/1994 | Ward | 405/244 X |

*Primary Examiner*—Wynn E. Wood
*Attorney, Agent, or Firm*—Paul M. Denk

[57] ABSTRACT

A socket drive adapter for retrofitting to a solid hub earth anchor to convert the solid hub earth anchor into a socket drive earth anchor. The socket drive adapter is formed from a trapezoidally shaped steel plate by a series of 90° bends. The bends create square, bore-defining adapter that can be welded to the top surface of the helical blade around the solid hub. A drive wrench fits in the socket drive adapter and engages both the socket drive adapter and the solid hub to enhance the torque strength of the anchor while retaining the better ground penetrating aspects of the solid hub design.

4 Claims, 3 Drawing Sheets

TUBULAR SOCKET DRIVE EARTH ANCHOR

BACKGROUND OF THE INVENTION

This invention relates generally to earth anchors and, more particularly, to a socket drive adapter for a solid hub helical earth anchor.

Conventional helical screw anchors were designed as solid steel hubs welded to helical form plates. There are a variety of earth anchors designed for penetration deep into the ground, having a solid central hub with a helical blade there around. The earth engaging end of the central hub can have a ground piercing tip and the opposite end has a means for engaging a drive tool. Often an elongated hub is used to screw the anchor into the ground. Alternatively, an elongated anchor wrench is applied over the solid hub to rotate the anchor. These solid hub designs work well in soft or easy to penetrate soils. However, they do not handle greater rotational forces required to penetrate hard, compacted or rocky soils.

In the 1980's anchors with socket drive designs were developed. Such socket drive designs are disclosed in U.S. Pat. No. 4,334,392 to Dziedzic, U.S. Pat. No. 4,467,575 to Dziedzic, U.S. Pat. No. 4,742,656 to Farmer, and U.S. Pat. No. 4,979,341 to Norman et al. Some of these patents are owned by a common assignee. Present day socket drive anchors used by utilities and others for guying purposes generally have an elongated, solid square shaft with a square type hub, the hub itself must be considerably larger in cross-section than the solid hub designs. One or more helical, outwardly extending, load bearing blades is welded to the hub. An elongated anchor rod is threadedly engaged to the shaft. For installation, an elongated anchor wrench, including a square tubular end section engages the anchor's square tubular hub. The wrench is rotated, which in turn rotates the shaft and blade so that the anchor is screwed into the earth. It will be appreciated that such socket drive earth anchors using a larger drive tube wrench have an increased torque capacity over an anchor that is rotated by the turning of a a relatively slender, solid anchor rod or the like.

There are several disadvantages associated with the socket drive earth anchors. First, the size of the tubular hub required to engage the drive wrench generally dictates the overall size of the central shaft which is encircled by the helical blade. There is a distinct disadvantage in this design in that it is difficult for a hub having a substantial cross-section to penetrate the soil, particularly hard, compacted or rocky soil. Penetration is enhanced by the use of larger, ground piercing lead points. However, the increased torque capacity of the anchor is partially consumed by the need to drive a larger opening in the soil. In effect, the increased torque capacity cannot be fully utilized since part of it is wasted force needed to overcome the soil's resistance to penetration by the larger hub.

Furthermore, solid hub earth anchors can be cast or forged in one piece. In some cases, the sold hub is forged and the helical blade separately welded on. The socket-type anchors, however, usually require more elaborate expensive manufacturing methods.

It would be advantageous, therefore, to have a socket-type earth anchor having a smaller shaft that is simple and less expensive to manufacture, yet capable of accommodating a powerful drive wrench.

SUMMARY OF THE INVENTION

It is among the principal objects of the present invention to provide a method and apparatus for retrofitting a solid hub earth anchor with a socket drive adapter to obtain the advantages of both a solid hub and tubular or socket drive earth anchor.

It is another object of the present invention to provide such a socket drive adapter that can be separately formed and welded to a solid hub earth anchor.

It is still another object of the present invention to provide such a socket drive adapter that allows the torque capacity of a solid hub earth anchor to be enhanced beyond the torque capacity of the solid hub design.

A further object of the invention is to provide an earth anchor having enhanced torque capacity and better soil penetration with less torque loss.

A still further object of the invention is to provide such a earth anchor that can be efficiently manufactured using a process that is flexible and efficient and avoids costly manufacturing process such as casting or forging.

In accordance with the invention, briefly stated, an earth anchor is provided wherein a solid hub anchor is retrofitted with a square socket drive adapter designed to accept a drive wrench. The socket drive adapter is formed from a trapezoidal section of steel by a series of bends. The bends yield a square, bore-defining adapter that can be welded to the top surface of the helical blade and surround the solid hub. The drive wrench fits in the socket drive adapter and over the solid hub. By engaging both socket drive adapter and the solid hub, the ultimate torque strength is enhanced.

Figure 1:
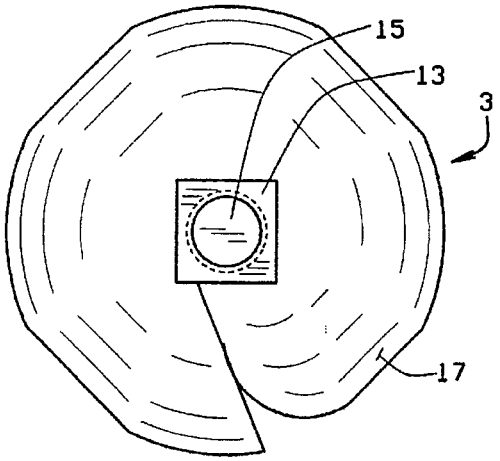
FIG. 1 PRIOR ART
FIG. 1 is a top plan of a prior art solid hub earth anchor.

Corresponding reference figures denote corresponding structures throughout the various figures.

DESCRIPTION OF THE PREFERRED EMBODIMENT

A socket drive adapter of the present invention is indicated generally in the various drawings by reference numeral 1. Socket drive adapter 1 is used to convert a solid hub earth anchor, indicated generally by reference numeral 3, into a socket drive earth anchor.

Figure 2:
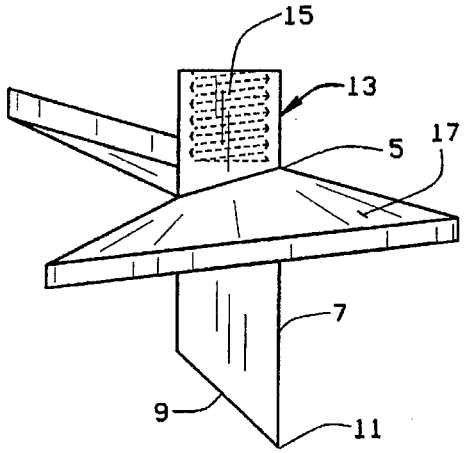
FIG. 2 PRIOR ART
FIG. 2 is a side elevational view thereof.

A solid hub earth anchor 3 is best illustrated in FIGS. 1 and 2. Anchor 3 has a central shaft 5. Shaft 5 has a shank 7 integrally formed with the shaft and extends downwardly therefrom. The shank has a beveled lower edge 9 forming a chisel tip 11 for penetrating the ground. A hub 13 is integrally formed from shaft 5 and extends vertically upward from the body. Hub 13 is generally square in cross-section and the center line of the hub corresponds essentially to the center line of the body. Hub 13 is substantially solid but has a bore 15 formed in the upper end. Bore 15 is internally threaded to accommodate a threaded end of an anchor rod.

A helical blade 17 is attachable to the shaft and hub. Blade 17 may be a multisided blade of the type disclosed in U.S. Pat. No. 4,742,656 or may be of any other suitable type such as those that are of a rounded or spiral design. Blade 17 is attached to shaft 5 and hub 13 in a suitable manner, usually by welding.

Figure 3:
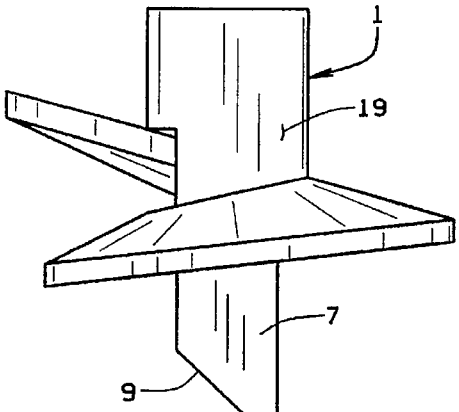
FIG. 3 is a side elevational view of an earth anchor having a socket drive adapter of the present invention thereon.
Figure 4:
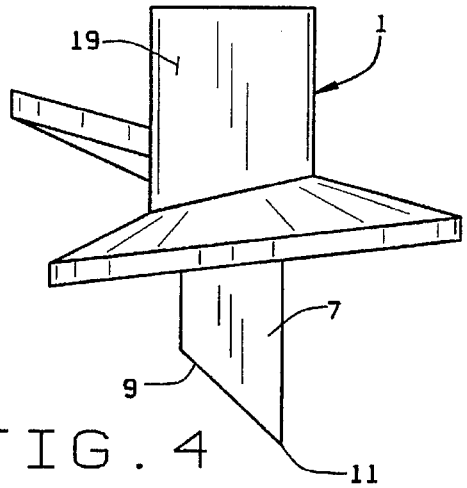
FIG. 4 is another side elevational view thereof.
Figure 5:
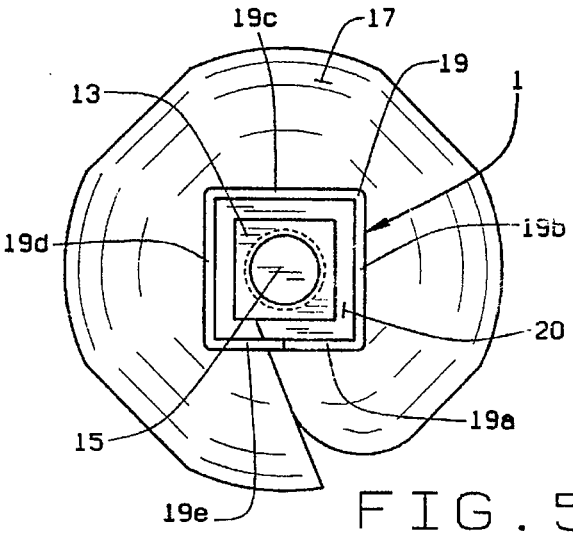
FIG. 5 is atop plan of the earth anchor of FIG. 3.
Figure 6:
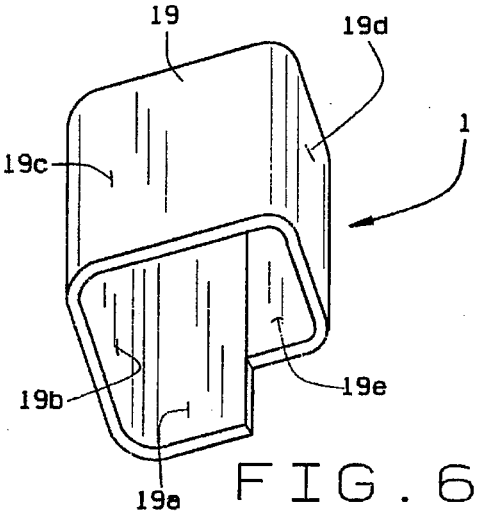
FIG. 6 is a perspective view of the socket drive adapter of the present invention.

FIGS. 3–5 illustrate a solid hub earth anchor 3 employing a socket drive adapter 1 of the present invention. Adapter 1 has a side wall 19 that extends upwardly from blade 17. Side wall 19 is rectangular or square in plan and has respective sections 19*a*–19*e*, as best seen in FIG. 6. The shaft 5 and shank 7 are smaller in cross-section than and concentric to the adapter. As best seen in FIG. 5, the side wall is spaced outwardly from hub 13 thereby forming a rectangular space 20 between side wall 19 and hub 13 for the introduction of a drive tool during anchor installation, as will now be described in greater detail.

Figure 7:
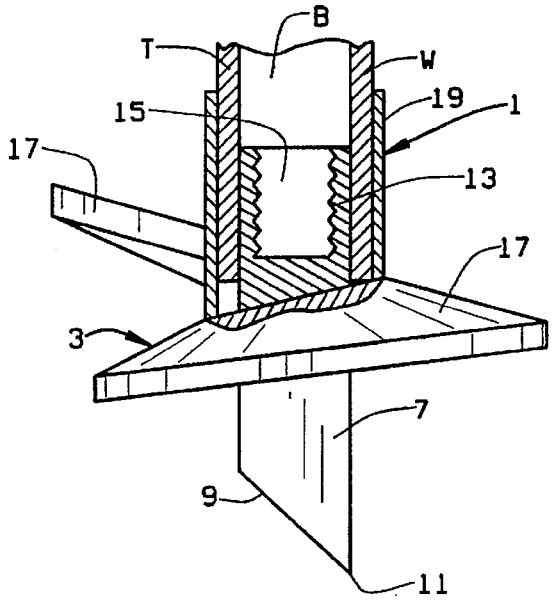
FIG. 7 is a side elevational view, partially in cross-section illustrating a driving wrench engaging an earth anchor employing a socket drive adapter of the present invention.

FIG. 7 illustrates the application of a drive tool T to an earth anchor employing a socket drive adapter of the present invention. It will be appreciated that drive tool T has a square tubular shank having a continuous wall W defining an axial bore B. Bore B is dimensioned to fit over hub 13 with the inner surface of the wall engaging the outer surface of hub 13. Hub 13 is similar in construction to the shaft 5 as previously explained. Tool T is dimensioned to fit in space 20 with the outer surface of wall W engaging the inner surface of wall 19. Because tool T engages both solid hub 13 and adapter 1, the ultimate torque strength of anchor 3 is enhanced.

Figure 8B:
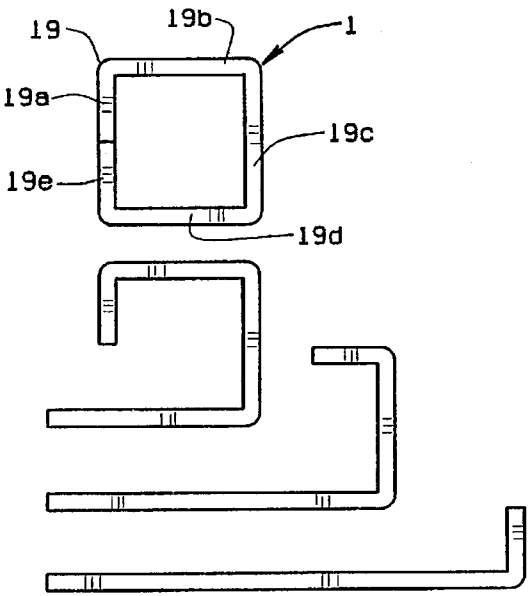
FIG. 8B is a series of drawings illustrating the bending pattern used on the plate of FIG. 7A to form a socket drive adapter of the present invention.
Figure 8A:
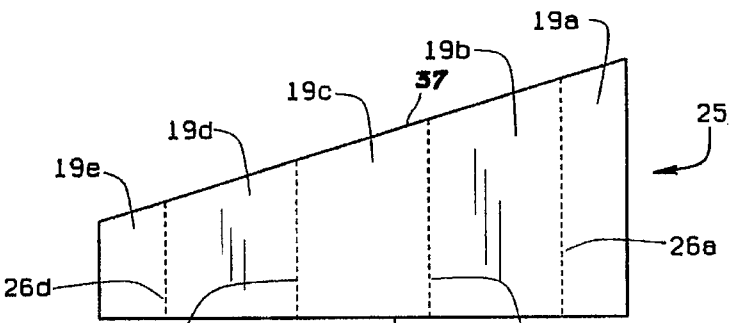
FIG. 8A is a front plan of one embodiment of the steel plate used to form the socket drive adapter of the present invention shown in FIG. 6.

FIGS. 8A and 8B illustrate the method of constructing a preferred embodiment of the socket adapter of the present invention. Adapter 1 is formed from a trapezoidal shaped plate of steel indicated generally by reference numeral 25. A conventional bending tool (not shown) is used to bend plate 25 into the appropriate configuration. Bends of 90° are made at points 26*a*–26*d* on plate 25. This procedure is best seen in FIG. 8B. Since the bends are made at a 90° angle, they are simple and easy to make. The finished adapter 1 (FIG. 6) is welded to the top side of blade 17 and concentric to solid hub 13 as previously described.

Figure 9B:
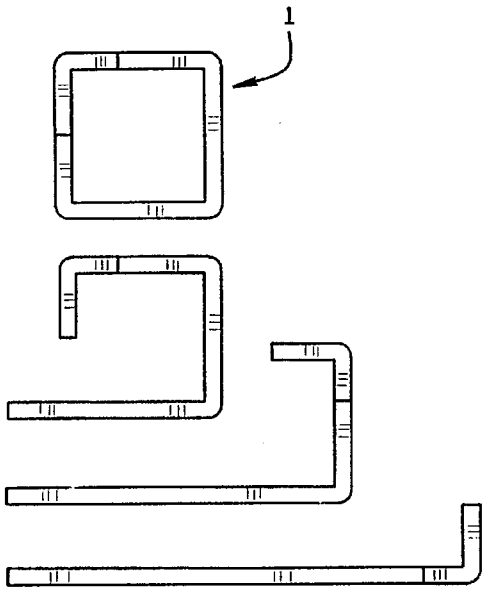
FIG. 9B is a series of drawings illustrating the bending pattern use on the plate of FIG. 8A to form a socket drive adapter of the present invention.
Figure 9A:
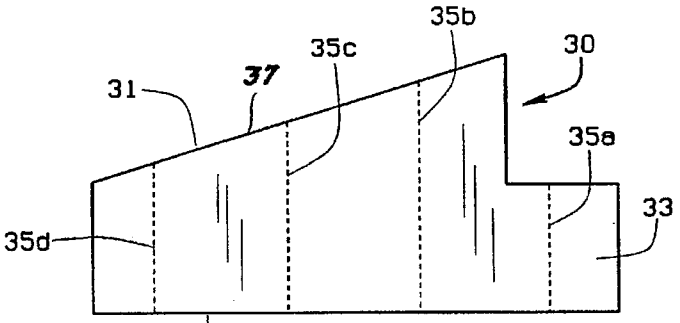
FIG. 9A is a front plan of another embodiment of the steel plate used to form another embodiment of a socket drive adapter of the present invention.

FIGS. 9A and 9B illustrate a method for constructing an alternative embodiment of an adapter 1 of the present invention. As shown in FIG. 9A, the adapter is formed from a sheet of steel indicated generally by reference numeral 30. Sheet 30 has a main section 31 which is substantially trapezoidal in shape. Sheet 30 also has a small tab 33 integrally attached to the wide end of main section 31. A conventional bending tool (not shown) is used to form the adapter by making discrete bends at positions 35*a*–35*d*. The bends are made at 90° angles, as shown in FIG. 9B.

The upper edge (36) of the adaptor and the lower inclined edge (37) of the adaptor are shown in both FIGS. 8A and 9A.

in FIGS. 8A and 9A show the upper edge (36) and the lower inclined edge (37) of the adaptor.

Figure 10:
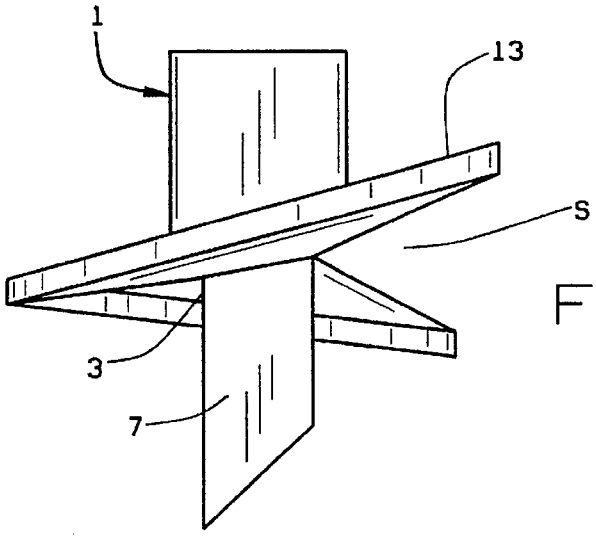
FIG. 10 is an isometric view of an earth anchor employing the socket drive adapter formed by the method shown in FIG. 9B.
Figure 11:
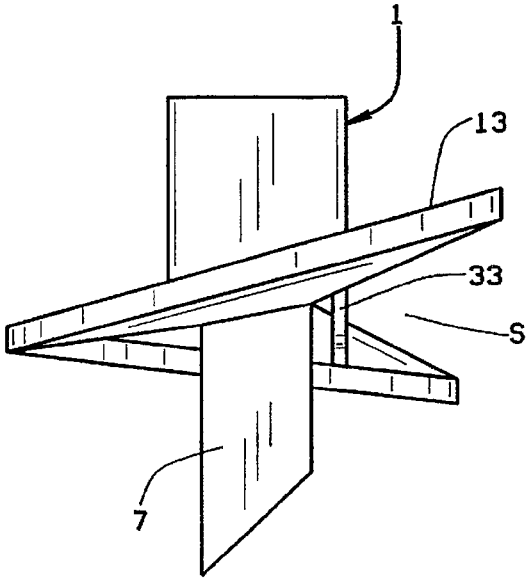
FIG. 11 is an isometric view of an earth anchor employing the socket drive adapter formed by the method shown in FIG. 8B.

FIGS. 10 and 11 compare earth anchors employing embodiments of the adapters constructed in accordance with the methods illustrated just described. FIG. 10 shows an earth anchor 3 employing the adapter 1 made in accordance with the method of FIGS. 9A and 9B. It will be appreciated that the mouth or space S between the turns of the helical blade is not restricted by the adapter. FIG. 11 shows an earth anchor 3 employing the adapter 1 made in accordance with the method described in FIGS. 8A and 8B. It will be noted that tab 33 (FIG. 9A) is positioned in the mouth or space S between the turns of the helical blade 13. Although this embodiment restricts the mouth of the anchor, it adds additional torque capacity to the anchor and is desirable to employ in conditions where benefit of the-additional torque capacity outweighs the disadvantage of partially restricting the mouth of the helical blade.

From the foregoing description and accompanying drawings it is apparent that the socket drive adapter of the present invention meets the various objects of the invention. A forged, solid hub earth anchor can be converted into a socket drive adapter without incurring the additional costs of casting or forging the entire socket drive earth anchor. The adapter can be formed separately on low cost bending tools and later welded to the solid hub earth anchor. The torque capacity is enhanced beyond the capacity of the solid hub design. However, the better soil penetrating quality of the solid hub design is maintained. Prototypes have been made and tested demonstrating that a standard 5000 ft.lb torque capacity anchor is enhanced to approximately 14,000 ft.lbs. torque to destruction.

It will be apparent that various changes and modifications may be made in the socket drive adapter of the present invention without departing from the scope of the appended claims. Therefore, the foregoing description and accompanying drawings are intended to be illustrative only and should not be construed in a limiting sense.

I claim:

1. An earth anchor capable of being forced into the ground through the use of a driving wrench and elongated Kelly rod, comprising:

a central shaft portion having a lower, ground engaging end, and an integral upper end;

an integral solid hub at said upper end, said hub having a substantially rectangular cross-section;

a helical blade, said helical blade having a central opening provided therethrough and accommodating the extension of the hub therein and its attachment thereto;

a generally rectangular, bore-defining socket adapter retrofitted around said hub to accommodate the introduction of a driving wrench;

said solid adapter formed from a generally trapezoidal shaped piece of flat steel, said shaped piece having a generally horizontally aligned upper edge, and an inclined lower edge, said shaped piece having a series of fold lines perpendicularly arranged with respect to its upper edge, whereby when said flat piece is folded it forms a generally rectangular bore defining adapter, said adapter's elongated upper edge surrounding the approximate upper end of the solid hub, and its inclined lower edge disposed for mating upon the subjacent helical blade and secured thereto by welding;

whereby the earth anchor is capable of accepting a driving wrench within the socket adapter and around the upper end of the solid hub to drive the anchor into the ground.

2. The earth anchor of claim 1 wherein said solid hub has a threaded bore formed therein for the threaded engagement of an elongated Kelly rod.

3. The earth anchor of claim 2 and wherein said flat plate when bent into the configuration of the socket adapter has a downwardly extending shoulder that arranges between flights of the helical blade when the socket adapter is welded to the helical blade during formation of said earth anchor.

4. The earth anchor of claim 3 and wherein said trapezoidal shaped piece forming the solid adapter integrally forms an extending tab, and said tab extending upwardly from the top flight of the helical blade when attached thereto during its welded installation.

* * * * *